US008683817B2

(12) United States Patent
Fraser

(10) Patent No.: US 8,683,817 B2
(45) Date of Patent: Apr. 1, 2014

(54) LOW AMBIENT OPERATING PROCEDURE FOR COOLING SYSTEMS WITH HIGH EFFICIENCY CONDENSERS

(75) Inventor: Eric B. Fraser, Canastota, NY (US)

(73) Assignee: Carrier Corporation, Farmington, CT (US)

( * ) Notice: Subject to any disclaimer, the term of this patent is extended or adjusted under 35 U.S.C. 154(b) by 167 days.

(21) Appl. No.: 13/203,660

(22) PCT Filed: Jun. 21, 2010

(86) PCT No.: PCT/US2010/039305

§ 371 (c)(1),
(2), (4) Date: Sep. 26, 2011

(87) PCT Pub. No.: WO2011/005470

PCT Pub. Date: Jan. 13, 2011

(65) Prior Publication Data

US 2012/0111030 A1 May 10, 2012

Related U.S. Application Data

(60) Provisional application No. 61/219,145, filed on Jun. 22, 2009.

(51) Int. Cl.
*F25D 3/12* (2006.01)

(52) U.S. Cl.
USPC ..... 62/56; 62/305; 62/428

(58) Field of Classification Search
USPC ..... 62/56, 115, 190, 305, 428, 183, 175
See application file for complete search history.

(56) References Cited

U.S. PATENT DOCUMENTS

| | | | | |
|---|---|---|---|---|
| 3,427,005 | A | 2/1969 | Kuykendall | |
| 3,556,200 | A | 1/1971 | Leonard | |
| 3,922,873 | A | 12/1975 | Leonard | |
| 4,067,205 | A | 1/1978 | Mayhue | |
| RE30,252 | E | 4/1980 | Leonard | |
| 4,528,823 | A * | 7/1985 | Mochizuki et al. | 62/324.6 |
| 4,739,628 | A | 4/1988 | Shoemaker | |
| 4,958,500 | A | 9/1990 | Kuroda et al. | |
| 5,067,560 | A * | 11/1991 | Carey et al. | 165/124 |
| 5,205,130 | A * | 4/1993 | Pannell | 62/236 |
| 5,307,645 | A * | 5/1994 | Pannell | 62/244 |
| 5,531,076 | A | 7/1996 | Pellenz et al. | |
| 5,649,428 | A * | 7/1997 | Calton et al. | 62/94 |
| 5,709,100 | A * | 1/1998 | Baer et al. | 62/259.2 |
| 6,293,119 | B1 * | 9/2001 | Wenzel | 62/238.6 |
| 6,434,963 | B1 | 8/2002 | Urch | |
| 6,606,872 | B1 * | 8/2003 | Smith | 62/175 |
| 6,743,670 | B2 | 6/2004 | Clevenger et al. | |

(Continued)

*Primary Examiner* — Mohammad M Ali
(74) *Attorney, Agent, or Firm* — Miller, Matthias & Hull LLP

(57) ABSTRACT

A multiple refrigerant circuit cooling system includes at least a first refrigerant circuit and a second refrigerant circuit. Each of said first and second refrigerant circuits including a compressor, a condenser, an expansion device and an evaporator connected in refrigerant flow communication. The condensers of the first and second refrigerant circuits each including condenser coils having exterior surfaces and each condenser including at least one fan for drawing ambient air across the exterior surfaces of its respective condenser coil. The exterior surfaces of the condenser coil of the condenser of the first refrigerant circuit being in fluid communication with the fan of the condenser of the second refrigerant circuit to provide reduced airflow across the exterior surfaces of the condenser coils of the first refrigerant circuit at a low ambient temperature.

20 Claims, 4 Drawing Sheets

(56) References Cited

U.S. PATENT DOCUMENTS

| | | | | |
|---|---|---|---|---|
| 6,763,670 | B1 | 7/2004 | Bushnell et al. | |
| 6,907,745 | B2 | 6/2005 | Turner et al. | |
| 6,945,061 | B2 * | 9/2005 | Nosaka | 62/175 |
| 7,342,756 | B2 * | 3/2008 | Lifson et al. | 361/22 |
| 2003/0213255 | A1 * | 11/2003 | Nosaka | 62/175 |
| 2005/0115254 | A1 * | 6/2005 | Knight et al. | 62/176.1 |
| 2006/0174640 | A1 * | 8/2006 | Caskey et al. | 62/183 |
| 2006/0201188 | A1 * | 9/2006 | Kopko | 62/333 |
| 2006/0213219 | A1 * | 9/2006 | Beving et al. | 62/468 |
| 2008/0006395 | A1 * | 1/2008 | Sanderlin et al. | 165/110 |
| 2008/0083237 | A1 * | 4/2008 | Street et al. | 62/196.4 |
| 2008/0289806 | A1 | 11/2008 | Gorbounov et al. | |

* cited by examiner

LOW AMBIENT OPERATING PROCEDURE FOR COOLING SYSTEMS WITH HIGH EFFICIENCY CONDENSERS

CROSS-REFERENCE TO RELATED APPLICATIONS

This is a US national phase patent application of International Patent Application No. PCT/US10/39305 filed on Jun. 21, 2010 filed pursuant to the Patent Cooperation Treaty and claims priority under 35 USC §119(e) to U.S. Provisional Patent Application Ser. No. 61/219,145 filed on Jun. 22, 2009.

BACKGROUND

1. Technical Field

Improved cooling systems with high-efficiency condensers are disclosed which provide improved performance at low ambient temperatures. Improved methods of operating cooling systems with high-efficiency condensers at low ambient temperatures are also disclosed.

2. Description of the Related Art

As shown in FIG. 1, large commercial cooling systems like the one shown at 10 generally include an evaporator 11, an accumulator 12, one or more compressors 13, one or more condensers 14 and a throttling device or expansion valve 15. The system 10 illustrated in FIG. 1 is a dual system with one refrigerant circuit 11, 13, 14, 15 shown at the left in FIG. 1 and a corresponding refrigerant circuit 11*a*, 13*a*, 14*a*, 15*a* shown at the right in FIG. 1. Referring to the refrigerant circuit 11, 13, 15 shown at the left in FIG. 1, refrigerant flows through the continuous refrigerant loop 19 of the refrigerant circuit 11, 13, 14, 15. A heat transfer fluid is circulated through heat transfer tubing 16 in the evaporator 11 to transfer heat from the heat transfer fluid to refrigerant passing through the evaporator 11. Alternatively, heat may be transferred from the air in a climate controlled area to the refrigerant in the evaporator 11 by means of a forced air process. The heat transfer fluid chilled in the evaporator tubing 16 is normally water or glycol, which is circulated to a remote location to satisfy a cooling load. The refrigerant in the evaporator 11 evaporates as it absorbs heat from the heat transfer fluid, and the compressors 13 operate to extract and compress this refrigerant vapor, and to discharge the compressed vapor to the condenser 14. In the condenser 14, the refrigerant vapor is condensed and the liquid refrigerant is delivered back to the evaporator 11 through the throttling device 15, where the refrigerant cycle begins again.

There is an increasing demand for energy efficient cooling systems. In the system 10 illustrated in FIG. 1, system capacity is gained by employing multiple compressors 13. At lower ambient temperatures, only one or perhaps two of the three compressors 13 are utilized. Further, at lower ambient temperatures, only one of the two refrigerant circuits 11, 13, 14, 15 or 11*a*, 13*a*, 14*a*, 15*a* are utilized. System efficiency is also typically gained by adding more surface area to the condensers 14, 14*a*.

Still referring to the refrigerant circuit 11, 13, 14, 15 shown at the left in FIG. 1, the combined surface area provided by the large condenser coil surface areas 17, 18 increases efficiency of the system 10 at high ambient temperatures, by lowering the discharge pressure of compressor 13, thus lowering the electricity consumed by compressor 13. This same concept also applies when the ambient temperature is low. Specifically, when a demand for air conditioning is made while the ambient temperature is low, the discharge pressure from the compressors 13 is too low, even with only one compressor 13 operating and the refrigerant cycle 11*a*, 13*a*, 14*a*, 15*a* shown at the right in FIG. 1 turned off. As a result, operation of the system 10 at low ambient temperatures cause the compressor 13 in the system to run outside of its safe operating range as the combination of low ambient temperatures and the high-efficiency condenser 14 design results in a great amount of heat being removed from the refrigerant cycle 11, 13, 14, 15 and discharged to the atmosphere which, in turn, results in lower than optimal discharge pressures at the lone compressor 13 that is operating. On one hand, unit software or low pressure switch may prevent the compressor 13 or system 10 from running at low ambient temperature conditions, to the dismay of the user. On the other hand, if the system 10 does operate at low ambient temperatures, compressor 13 failure may occur, also to the dismay of the user.

One way to operate the system 10 safely at low ambient temperature conditions is to lower airflow across the condenser 14, which reduces the heat removal through the condenser 14 thereby increasing discharge pressure to a safer level at the compressor 13. Therefore, in order to operate the system 10 at low ambient temperature conditions, variable speed motors 21, 22 need to be installed to control the speed of the fans 23, 24, which is expensive, labor intensive and requires a more complicated control system (not shown).

Accordingly, improved methods for operating cooling systems at low ambient temperatures and improved cooling systems systems that operate safely and efficiently at low ambient temperatures are desired.

SUMMARY OF THE DISCLOSURE

An improved multiple refrigerant circuit cooling system is disclosed that may be safely operated at low ambient temperatures, e.g., temperatures at or below about room temperature. One disclosed system comprises at least a first refrigerant circuit and a second refrigerant circuit. Each of said first and second refrigerant circuits comprises a compressor, a condenser and an evaporator connected in refrigerant flow communication. The condensers of the first and second refrigerant circuits each comprise condenser coils having exterior surfaces and each condenser comprising at least one fan for drawing ambient air across the exterior surfaces of its respective condenser coil. The exterior surfaces of the condenser coils of the condenser of the first refrigerant circuit being in fluid communication with the fan of the condenser of the second refrigerant circuit to provide reduced airflow across the exterior surfaces of the condenser coils of the first refrigerant circuit at low ambient temperatures.

A method for operating the cooling system described above is also disclosed which comprises: receiving a demand for a cooling load; sensing the ambient temperature; when the ambient temperature is below a threshold value, activating the first refrigerant cycle without activating the second refrigerant cycle, deactivating the fan of the condenser of the first refrigerant cycle if the discharge pressure is below safe operating limit, and activating the fan of the condenser of the second refrigerant cycle, and, removing heat from the first refrigerant cycle by drawing a reduced air flow across the exterior surfaces of the condenser coil of the condenser of the first refrigerant using the fan of the condenser of the second refrigerant circuit.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 2:
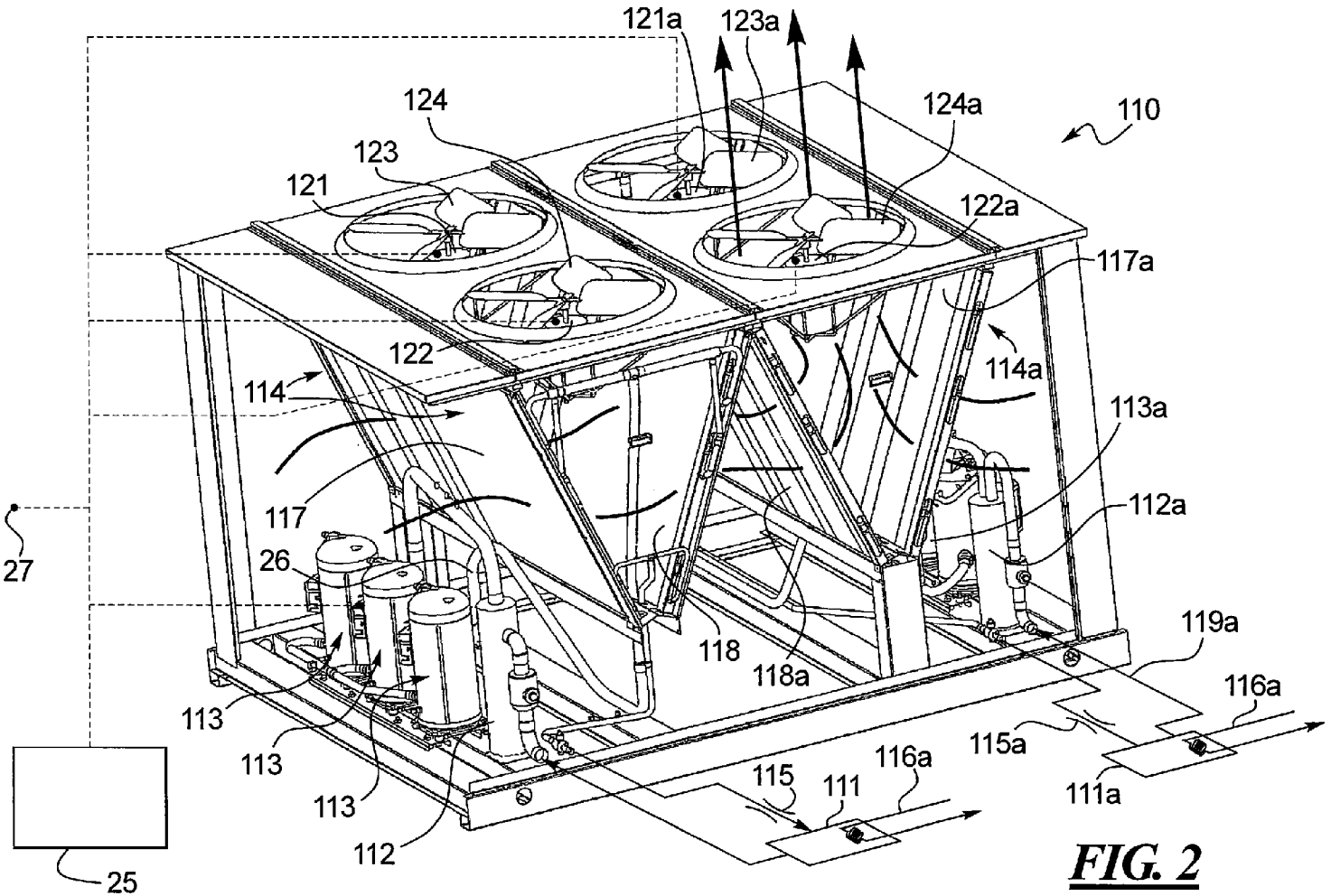
FIG. 2 is a perspective and schematic view of a commercial cooling system with two refrigerant cycles and an improved control system and control scheme for reducing the airflow across one of the condensers when the ambient temperature is low.

The HVAC industry is under heavy pressure to build and design energy efficient products. As noted above, multiple compressors, multiple evaporators and multiple refrigerant circuits are common design strategies. System efficiency is also typically gained by adding more surface area to the condensers 114, 114*a* illustrated in FIG. 2. One such strategy is to arrange the condenser coils in a v-shaped configuration with two condenser coil areas 117, 118 and 117*a*, 118*a* as illustrated in FIG. 2. Micro-channel heat exchanger type (MCHX) coils also increase efficiency of the condensers 114, 114*a*.

Low ambient temperatures will be defined as ambient temperatures at or about room temperature as well as below room temperature. For purposes of operating commercial air-conditioning systems, the term low ambient temperatures will refer to temperatures ranging from about freezing to about room temperature. Thus, for purposes of this disclosure, low ambient temperatures will range from about −17.8° C. (0° F.) to about 22° C. (72° F.).

In a typical operation at low ambient temperature, the system 110 will operate only one refrigerant cycle, such as the cycle 111, 113, 114, 115 while leaving the second refrigerant cycle 111*a*, 113*a*, 114*a*, 115*a* dormant or inactive. Further, only one of the three compressors 113 may be operating due to the decreased load requirements when operating a cooling system at low ambient temperatures. Even with only a single compressor 113 operating, the design strategies for increasing the efficiency of the condensers 114 at high ambient temperatures has an adverse effect on compressor operation at low ambient temperatures, because the increased surface areas 117, 118 draw too much heat from the refrigerant cycle 111, 113, 114, 115 thereby resulting in an insufficient discharge pressure at 26 from the compressor 113. If the discharge pressure 26 of the compressor 113 is too low, the compressor 113 may be operating outside of its normal or safe range and the compressor 113 may fail. Disclosed herein is system and method for using large surface area condensers like those shown at 114, 114*a* in FIG. 2 at low ambient temperatures, without sacrificing performance, efficiency or undue wear and tear on the compressors 113, 113*a*.

As shown in FIG. 2, the cooling system 110 is a split system with two refrigerant circuits including a first refrigerant circuit 111, 113, 114, 115 and a second refrigerant circuit 111*a*, 113*a*, 114*a*, 115*a*. Each evaporator 111, 111*a* is equipped evaporator tubing 116, 116*a* that transfers heat to the refrigerant in the refrigerant tubing 119, 119*a*. The compressors 113, 113*a* may be linked to the controller 25 and compressor discharge pressure sensors 26, 26*a* (see FIG. 3) may also be linked to the controller 25, although in practice, the disclosed system 110 and associated methods, only one compressor discharge sensor 26 may be desired because, at low ambient temperatures, as only one of the two refrigerant circuits 111, 113, 114, 115 will be operational.

At low ambient temperatures, as measured by the ambient temperature sensor 27, the controller 25 will operate only one of the refrigerant cycles, in this example, the refrigerant cycle 111, 113, 114, 115 shown at the left in FIG. 2. The second refrigerant cycle 111*a*, 113*a*, 114*a*, 115*a* remains idle. However, the controller 25 also operates the fan motors 121, 122 and 121*a*, 122*a*. In this disclosed system 110, the fan motors 121, 122, 121*a*, 122*a* may be single stage or constant speed motors as variable speed motors and variable speed drives are not necessary for the reasons explained herein. The use of single speed motors 121, 122, 121*a*, 122*a* are less expensive, require a simpler and less expensive control system and are easier to operate and maintain than variable speed motors.

To reduce the airflow through the energy-efficient condenser 114, the fan motors 121, 122 are deactivated by the controller 25 and the fan motors 121*a*, 122*a* of the compressor 114*a* of the idle refrigerant cycle 111*a*, 113*a*, 114*a*, 115*a* are activated by the controller 25 without activating the compressors 113*a* or pump or fan (not shown) associated with the evaporator 111*a*.

Referring to FIG. 2, the condensers 114, 114*a* are preferably arranged in a side-by-side fashion. As a result, activation of the fan motors 121*a*, 122*a* will draw air through the panels 117, 118 of the activated condenser 114, up through the panel 118*a* of the deactivated condenser 114*a* and through one or more of the fans 123*a*, 124*a* of the deactivated condenser 114*a*. This airflow scheme results in reduced airflow across the exterior surfaces of the heat exchanger coils of the activated condenser 114 thereby reducing the heat transfer of the condenser 114 at low ambient temperatures without a significant increase in energy usage. As a result, with the reduced heat transfer of the condenser 114, the discharge pressure at the compressor 113 is maintained at an acceptably high level thereby reducing the risks associated with operating the compressor 113 at unacceptably low discharge pressures.

Figure 3:
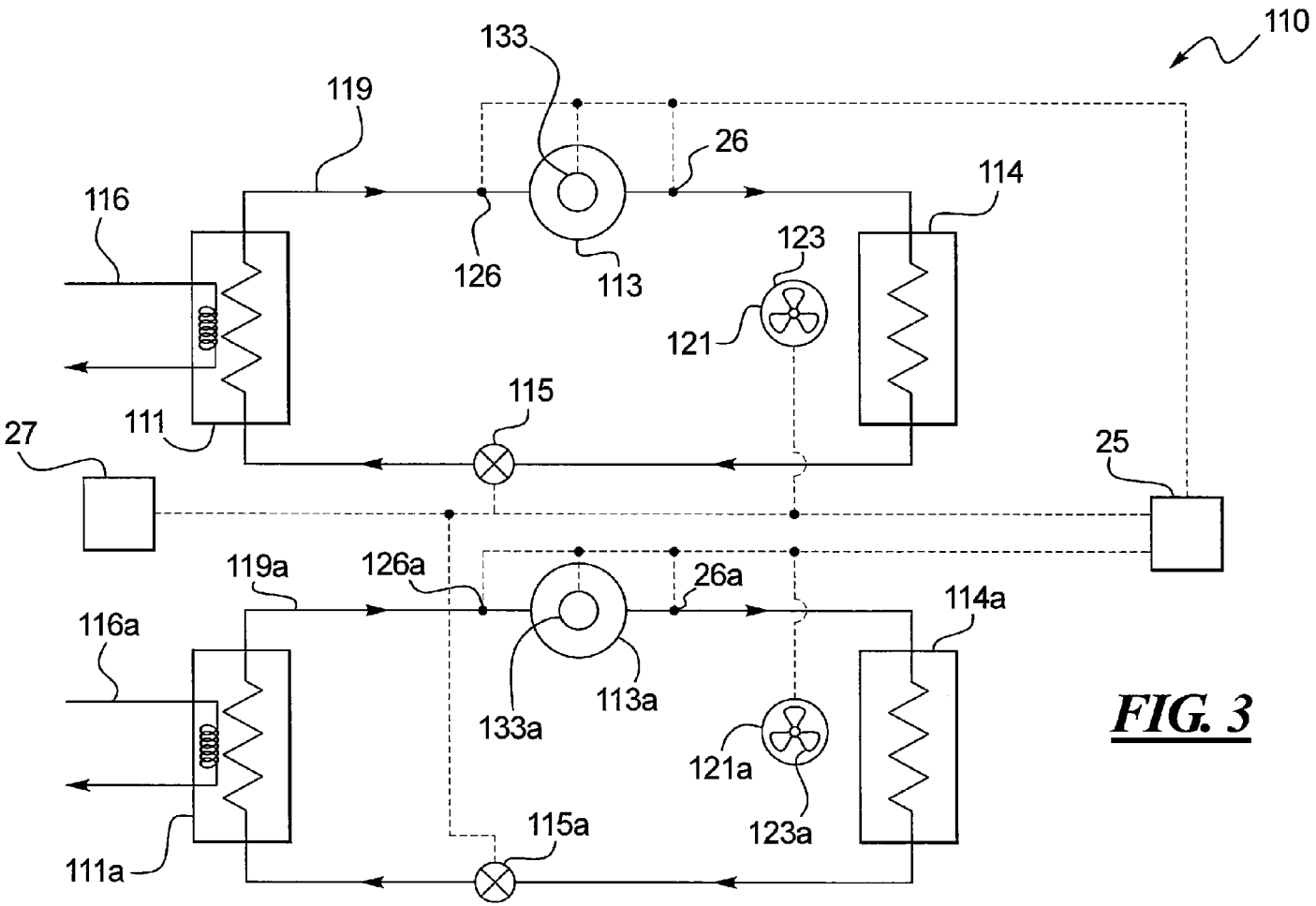
FIG. 3 is a schematic illustration of the cooling system shown in FIG. 2.

FIG. 3 is a simplified schematic illustration of the system 110 of FIG. 2. The controller 25 may be linked to a plurality of inputs and devices including the ambient temperature sensor 27, the motors 133 133*a* of the compressors 113, 113*a*, the expansion valves 115, 115*a*, the fan motors 121, 121*a* and pumps or fans (not shown) associated with the evaporators 111, 111*a*. As noted above, more than two evaporators 111, 111*a*, more than two compressors 113, 113*a* and more than two condensers 114, 114*a* may be employed. In addition to discharge pressure sensors 26, 26*a*, the controller 25 may be linked to compressor input pressure sensors 126, 126*a* as well to provide a pressure drop reading across each compressor 113, 113*a*. However, in practicing the principles of this disclosure, it may be necessary only to obtain one of: an ambient temperature reading of the sensor 27; a discharge pressure reading at the sensor 26; a combination of ambient temperature at 27 and discharge pressure at 26; a pressure drop between the sensors 126, 26; or combination of ambient temperature at 27 and pressure drop across the sensors 126, 26. Various techniques for determining the appropriate ambient temperature or other operating condition at which to run the system 110 using one condenser 114 and one or more fans 123*a*, 124*a* of an idle condenser 114*a* can be employed as will be apparent to those skilled in the art.

Figure 1:
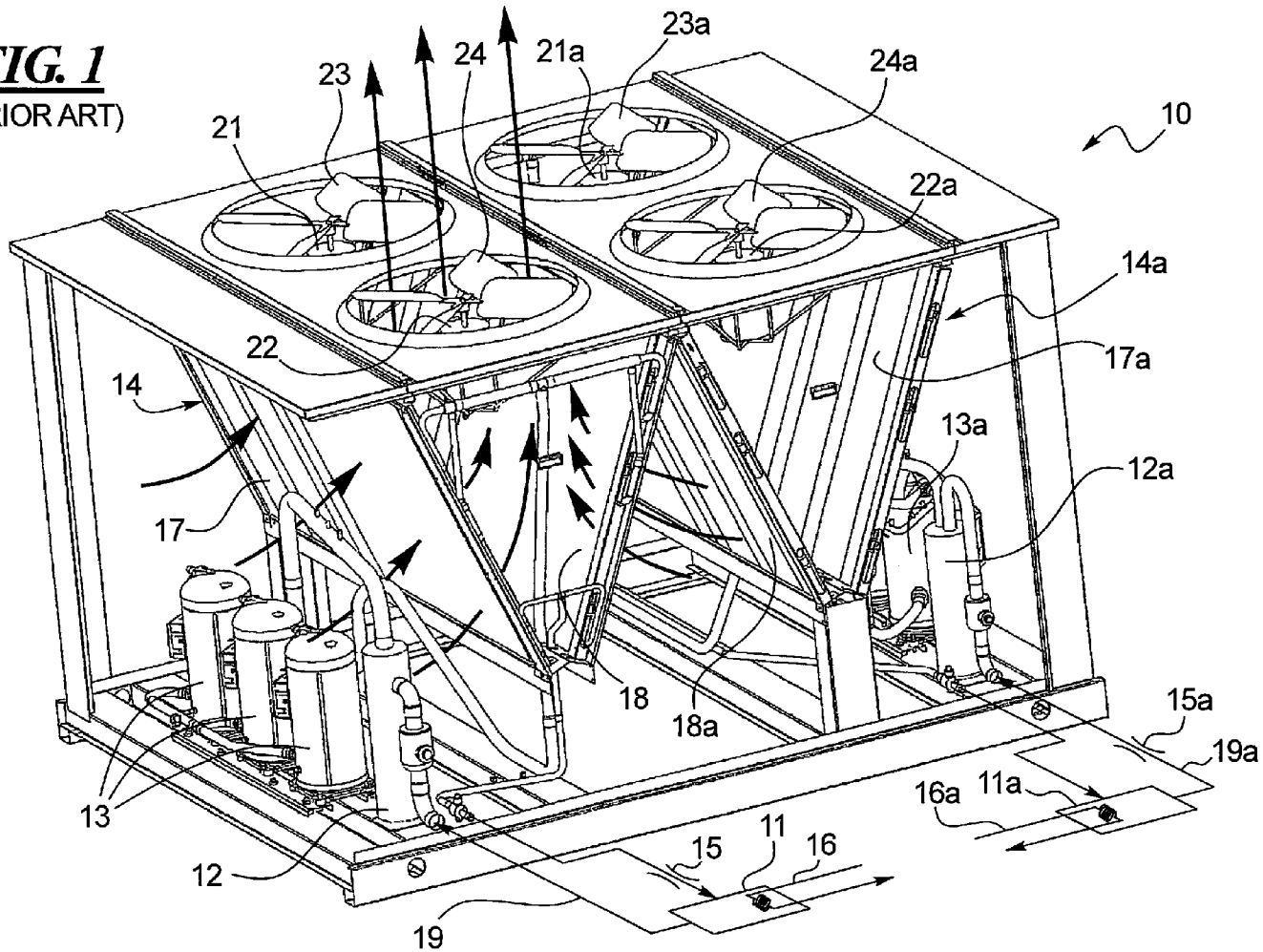
FIG. 1 (PRIOR ART)
FIG. 1 is a perspective and schematic view of a commercial cooling system with two refrigerant cycles.
Figure 4:
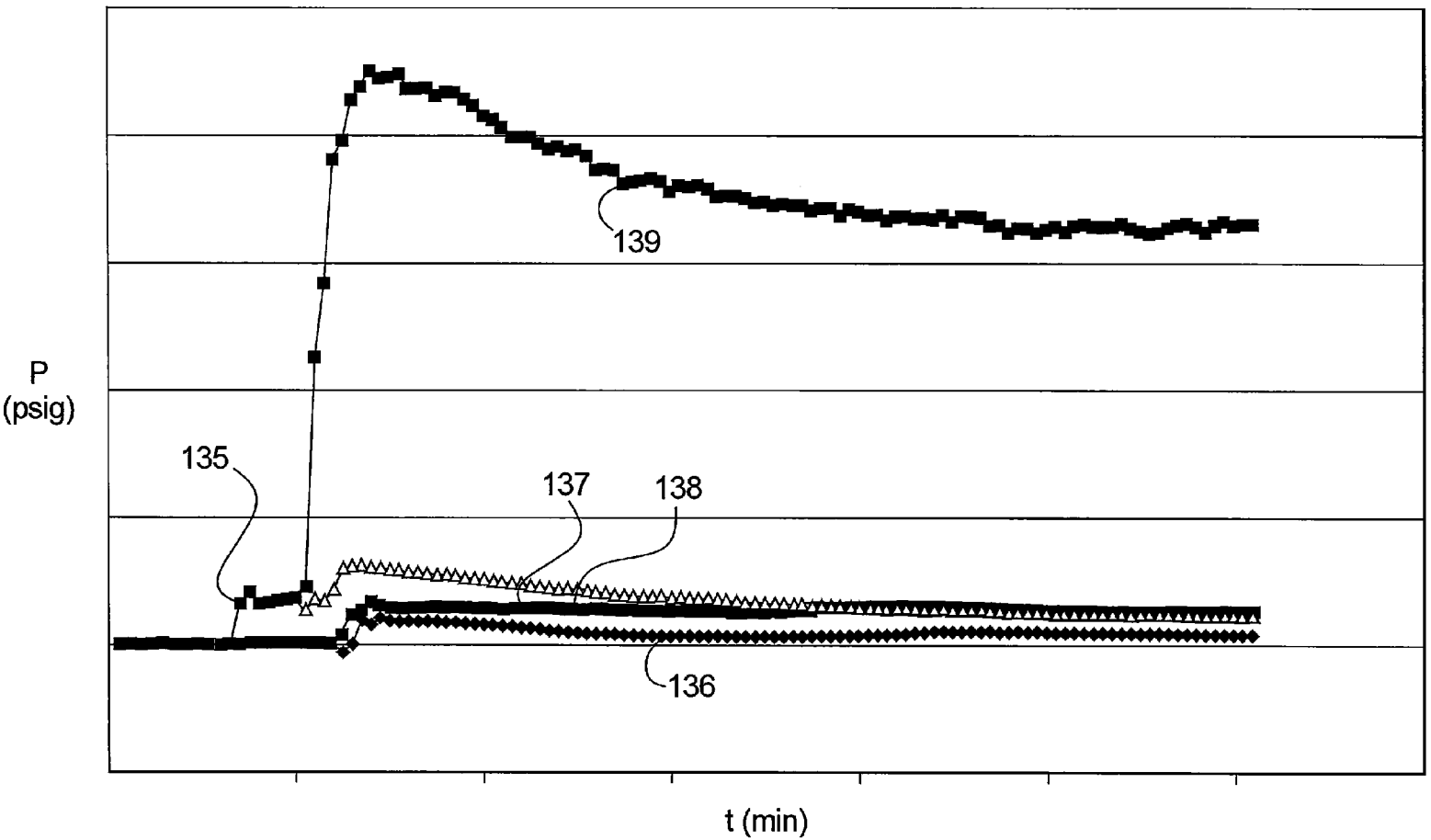
FIG. 4 graphically illustrates the improved discharge pressure at the compressor at low ambient temperatures (e.g., 0° C./32° F.) when utilizing the cooling systems in accordance with FIGS. 2 and 3.

The benefits of utilizing this cooling system 110 and methods of operating the cooling system 110 disclosed herein are illustrated in FIG. 4, which compares operation of the system 110 (FIGS. 2-3) with the prior art system 10 (FIG. 1). Data points were taken over an extended interval at an ambient temperature of about 0° C. (32° F.). The system startup is indicated at 135. In the prior art system 10, the suction pressure is indicated at 136 and the discharge pressure is indicated at 137. Obviously, the pressure drop between the suction 136 and discharge 137 pressures is insufficient and the compressor discharge pressure 137 is unacceptably low. In contrast, utilizing the disclosed system 110, the compressor suction pressure is indicated at 138 and the compressor discharge pressure at 139. Operating a single refrigerant circuit such as the one shown at 111, 113, 114, 115 in FIGS. 2-3 and utilizing the fan 123*a* of an adjacent idle condenser 114*a* sufficiently decreases the heat transfer of the condenser 114 without a significant increase in energy usage and results in an increase in the discharge pressure as indicated at 139 and FIG. 4. As a result, the system 110 can be operated safely at ambient temperatures below room temperature and even ambient temperatures approaching and below freezing by operating a single refrigerant circuit and utilizing the fan or air pump of an adjacent idle condenser to draw the cool ambient air across the condenser that is in use.

By utilizing the airflow from the "off" refrigerant circuit 111*a*, 113*a*, 114*a*, 115*a* to increase the compressor 113 discharge pressure in the "on" circuit 111, 113, 114, 115, large systems 110 with multiple "V" condenser sections 114, 114*a* can be operated safely at low ambient temperatures without a significant increase in energy usage. Using the airflow from the "on" refrigerant circuit 111, 113, 114, 115 results in too much airflow across the condenser 114 at low outside temperatures, which lower the compressor 113 discharge pressure 26, falling below the safe operating range of the typical compressor 113. However, using one or more of the fans 123*a*, 124*a* from the "off" circuit 111*a*, 113*a*, 114*a*, 115 "steals" enough air from the "on" circuit 111, 113, 114, 115 to run the system 110 at acceptable compressor 113 discharge pressures 26 as illustrated at 139 in FIG. 4.

The system 110 and control methods described above provide increased compressor 113 discharge pressures 26 at low outside air temperatures without the use of any additional installed items such as variable speed motors, variable speed drives or the control systems associated therewith. All that is required is a simplified control or software that activates at least one fan 123*a* or 124*a* from the "off" circuit 111*a*, 113*a*, 114*a*, 115*a* instead of the fans 123, 124 from the "on" circuit 111, 113, 114, 115 when the system 110 is operated at low ambient temperatures. No additional parts or unit costs are associated with the disclosed systems 110 and methods of operation thereof.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A multiple refrigerant circuit cooling system comprising:

at least a first refrigerant circuit and a second refrigerant circuit, each of said first and second refrigerant circuits comprising a compressor, a condenser, an expansion device and an evaporator connected in refrigerant flow communication;

the condensers of the first and second refrigerant circuits each comprising condenser coils having exterior surfaces and each condenser comprising at least one fan for drawing ambient air across the exterior surfaces of its respective condenser coil;

the exterior surfaces of the condenser coil of the condenser of the first refrigerant circuit being in fluid communication with the at least one fan of the condenser of the second refrigerant circuit to provide reduced airflow across the exterior surfaces of the condenser coil of the condenser of the first refrigerant circuit when a discharge pressure of the compressor of the first refrigerant circuit is below a compressor discharge pressure threshold value.

2. The system of claim 1 further comprising a controller linked to an ambient temperature sensor, the first and second refrigerant circuits and the at least one fan of the condensers of the first and second refrigerant circuits, the controller being configured to deactivate the second refrigerant circuit when an ambient temperature measured by the ambient pressure sensor is below a first threshold value.

3. The system of claim 1 further comprising a controller linked to a discharge pressure sensor to measure the discharge pressure of the compressor of the first refrigerant circuit, the controller further being linked to the first and second refrigerant circuits and the at least one fan of the condensers of the first and second refrigerant circuits, the controller being configured to deactivate the at least one fan of the condenser of the first refrigerant circuit and to the activate the at least one fan of the second refrigerant circuit when the discharge pressure of the compressor of the first refrigerant circuit is below the compressor discharge pressure threshold value.

4. The system of claim 1 wherein the condenser coils of the condensers of the first and second refrigerant circuit are arranged in a v-shaped configuration.

5. The system of claim 4 wherein the condensers of the first and second refrigerant circuit are arranged in a side-by-side configuration.

6. The system of claim 4 wherein the condenser coils of the condensers of the first and second refrigerant circuits are micro-channel heat exchanger (MCHX) coils.

7. The system of claim 1 wherein the at least one fan of each of the condenser of the first and second refrigerant circuits has connected thereto a constant speed motor, each constant speed motor being linked to a controller, the controller configured to deactivate the constant speed motor of the condenser of the first refrigerant circuit and to activate the constant speed motor of the condenser of the second refrigerant circuit when the discharge pressure is below the compressor discharge pressure threshold value.

8. The system of claim 1 wherein the at least one fan of each of the condenser of the first and second refrigerant circuits has connected thereto a constant speed motor, each constant speed motor being linked to a controller, the controller configured to deactivate the constant speed motor of the condenser of the first refrigerant circuit and to activate the constant speed motor of the condenser of the second refrigerant circuit when a pressure drop between a suction pressure and the discharge pressure of the compressor of the first refrigerant circuit is below a second threshold value.

9. The system of claim 2, wherein the first refrigerant circuit comprises a plurality of compressors and the controller being programmed to deactivate all but one of the plurality of compressors of the first refrigerant circuit when the ambient temperature is below the first threshold value.

10. The system of claim 1, further comprising a controller linked to an input pressure sensor of the compressor of the first refrigerant circuit, the first and second refrigerant circuits and the at least one fan of the condensers of the first and second refrigerant circuits, the controller being configured to deactivate the second refrigerant circuit when a pressure drop between a pressure measured by the input pressure sensor and the discharge pressure is below a second threshold value.

11. The system of claim 2 wherein the ambient temperature is defined as being less than or equal to about 22° C.

12. The system of claim 2 wherein the first threshold value is less than or equal to about 22° C.

13. A method for operating a cooling system that includes a first refrigerant circuit and an adjacent second refrigerant circuit, the method comprising:

receiving a demand for a cooling load;

activating the first refrigerant circuit;

sensing a discharge pressure at a compressor of the first refrigerant circuit, and when the discharge pressure at the compressor of the first refrigerant circuit is below a compressor discharge pressure threshold value, deactivating a fan of a condenser of the first refrigerant circuit and activating a fan of a condenser of the adjacent second refrigerant circuit; and removing heat from the first refrigerant circuit by drawing a reduced air flow across the condenser of the first refrigerant circuit using the fan of the condenser of the second refrigerant circuit.

14. The method of claim 13, wherein the first refrigerant circuit comprises a plurality of compressors, and the method further comprises deactivating all but one of the compressors of the first refrigerant circuit when an ambient temperature is below a first threshold value.

15. The method of claim 13 wherein the activating of the first refrigerant circuit further comprises activating the first refrigerant circuit without activating the second refrigerant circuit when an ambient temperature is below a first threshold value.

16. The method of claim 14, wherein the first threshold value ranges from about a negative 17.8° C. to about a positive 22° C.

17. The method of claim 13, wherein activating the fan of the condenser of the adjacent second refrigerant circuit comprises activating a motor associated with the fan of the condenser of the adjacent second refrigerant circuit.

18. The method of claim 17, wherein the motor is a constant speed motor.

19. A method for operating a cooling system when an ambient temperature is less than or about room temperature, the cooling system including a first refrigerant circuit and an adjacent second refrigerant circuit, the method comprising:

receiving a demand for a cooling load;

sensing the ambient temperature, and when the ambient temperature is less than or about room temperature, activating the first refrigerant circuit without activating the second refrigerant circuit;

sensing a discharge pressure at a compressor of the first refrigerant circuit, and when the discharge pressure at the compressor of the first refrigerant circuit is below a compressor discharge threshold value, deactivating a fan of a condenser of the first refrigerant circuit and activating a fan of a condenser of the second refrigerant circuit without activating the second refrigerant circuit; and removing heat from the first refrigerant circuit by drawing a reduced air flow through the condenser-of the first refrigerant circuit using the fan of the condenser of the second refrigerant circuit.

20. The method of claim 19, wherein the first refrigerant circuit comprises a plurality of compressors, and the method further comprises deactivating all but one of the compressors of the first refrigerant circuit when the ambient temperature is less than or about room temperature.

* * * * *